United States Patent [19]

Laugesen

[11] 4,326,860

[45] Apr. 27, 1982

[54] RIPPLE INSENSITIVE ELECTRIC PRECIPITATORS

[75] Inventor: Thomas C. Laugesen, Silverton, N.J.

[73] Assignee: NWL Transformers, Bordentown, N.J.

[21] Appl. No.: 211,335

[22] Filed: Nov. 28, 1980

[51] Int. Cl.[3] ..... B03C 3/68

[52] U.S. Cl. ..... 55/105; 323/242; 323/903

[58] Field of Search ..... 55/105, 139; 323/242, 323/245, 246, 903; 363/46

[56] References Cited

U.S. PATENT DOCUMENTS

| | | | |
|---|---|---|---|
| 2,961,577 | 11/1960 | Thomas et al. | 55/105 |
| 2,992,699 | 7/1961 | Jarvinen | 55/105 |
| 3,453,526 | 7/1969 | Bowles | 55/105 |
| 3,648,437 | 3/1972 | Bridges | 55/105 |
| 3,745,749 | 7/1973 | Gelfand | 323/903 X |
| 3,761,797 | 9/1973 | Spooner | 363/46 |
| 3,772,853 | 11/1973 | Burge et al. | 55/105 |
| 3,829,754 | 8/1974 | Rettig | 363/37 |
| 3,873,282 | 3/1975 | Finch | 323/903 X |
| 3,898,551 | 8/1975 | Webb | 322/28 |
| 4,013,936 | 3/1977 | Hesler et al. | 363/25 |
| 4,138,232 | 2/1979 | Winkler et al. | 55/105 |
| 4,152,124 | 5/1979 | Davis | 323/903 X |
| 4,195,333 | 3/1980 | Hedel | 363/46 X |

*Primary Examiner*—A. D. Pellinen

*Attorney, Agent, or Firm*—Ratner & Prestia

[57] ABSTRACT

A control system for automatically maintaining a maximum output voltage across the electrodes of a precipitator under varying load conditions without requiring manual readjustment of sensitivity controls. A spark threshold detector provides a threshold crossing signal when a spark occurs across the electrodes of the precipitator. Control circuitry including a ramp generator is responsive to the threshold crossing signal for providing a ramp signal which is effective to vary the voltage applied to the precipitator as a function of the desired spark rate. A sensitivity adjust circuit produces a compensating signal proportional to the magnitude of the ripple on the voltage applied to the precipitator. The DC level of the spark threshold detector is adjusted in accordance with the compensation signal so that the detector is insensitive to variations in the ripple whereby the predetermined spark rate is automatically maintained.

8 Claims, 7 Drawing Figures

SCR TRIGGER
SCR LEVEL AMP. 43
SPARK RATE RAMP GEN. 37
AUTO START DELAY 9
DELAY TIMER
RATE ADJ.
ONE-SHOT
SETBACK TRIGGER GEN. 38
PULSE WIDTH ADJ.
QUENCH TRIGGER GEN. 34
PULSE AMP. 36
THRES. DET.
SPARK THRESHOLD DET. 18
CUR. SENS. ADJ.
AUTO. SENSITIVITY ADJ. 17
KV INPUT
DCI

SETBACK TRIG.
O VOLTS

PULSE AMP. OUTPUT (QUENCH)
O VOLTS

QUENCH INT.
OF PRECIP 7
$T_4$
RAMP VOLTAGE
E spark
E setback
SETBACK INT.
$T_1$
$T_2$
$T_3$

CURRENT SENS. (DCI)
DC LEVEL
RIPPLE
SPARK
SPARK
O VOLTS

EFFECT OF ADJ. 17 ON JUNCTION 26A
O VOLTS
P VOLTS
DC FROM RIPPLE
INC. IN RIPPLE VOLTAGE (RANDOM)
DC DER. FROM LARGER VALUE RIPPLE

RIPPLE INSENSITIVE ELECTRIC PRECIPITATOR

BACKGROUND OF THE INVENTION

A. Field of the Invention

This invention relates to the automatic control of the potential applied across the electrodes of an electrostatic precipitator employing a relatively high DC voltage for purposes of particle removal from a gaseous stream.

B. Background Art

Electrostatic precipitators suffer from a sparking or arcing condition as the potential is raised to achieve more thorough particle removal. When sparking occurs, the device does not perform the precipitation function and can increase its power consumption to self destructive levels.

As described, for example, in U.S. Pat. No. 4,152,124, sparking is effected by many variable parameters, and may therefore be initiated under varying combinations of precipitator high voltage and current conditions. Within the prior art, adaptive sensitivity control devices have been developed that sense the presence of a spark and control the rate of sparks generated per unit time. Typically, electrode potential is repetitively brought up to the sparking threshold and set back (i.e. lowered to a value that does not trigger sparking). In this manner it has been desired to achieve a maximum output voltage at which the number of potentially harmful sparks per unit time are maintained at a predetermined rate. It is in this manner that the highest quantity of particles may be removed by the precipitator.

However, manual readjustment of the sparking rate controls has been required since the prior art had not recognized that the voltage across the precipitator electrodes as well as the current passing through the device contain a ripple component that can falsely trigger spark sensing circuits. The ripple is a result of the AC-to-DC rectification process used to develop the precipitator's high voltage DC. The magnitude of the ripple undesirably varies as a function of a number of load factors and conditions including the conductivity of the particles being extracted and the dialectric constant of the gaseous stream passing through the precipitator.

Accordingly, an object of the present invention is an automatic control system which maintains maximum output voltage from the transformer rectifier set under varying load conditions within a precipitator without requiring manual readjustment of sensitivity controls.

Another object is to discriminate between spark pulses and varying levels of ripple to allow a predetermined spark rate to be automatically maintained in the presence of varying ripple.

SUMMARY OF THE INVENTION

A control system for automatically controlling the voltage across a precipitator to maintain a desired spark rate across the electrodes of the precipitator. An attenuated precipitator signal is produced proportional to the current flowing through or the voltage applied to the precipitator and which includes DC, ripple and spark components. A spark threshold detector is effective to detect when the attenuated precipitator signal exceeds a predetermined threshold thereby to produce a threshold crossing signal. The control system is responsive to the threshold crossing signal and produces a ramp signal for varying the voltage applied to the precipitator as a function of the desired spark rate. An automatic sensitivity adjustor produces a compensating signal proportional to the magnitude of the ripple content in the attenuated precipitator signal. The spark threshold detector includes means for adjusting the DC level of the attentuated precipitator signal in accordance with the compensating signal so that the spark threshold means is insensitive to variations in the ripple component. In this manner the automatic control system maintains maximum output voltage under varying load conditions without manual readjustment.

DESCRIPTION OF THE PREFERRED EMBODIMENT

Figure 1:
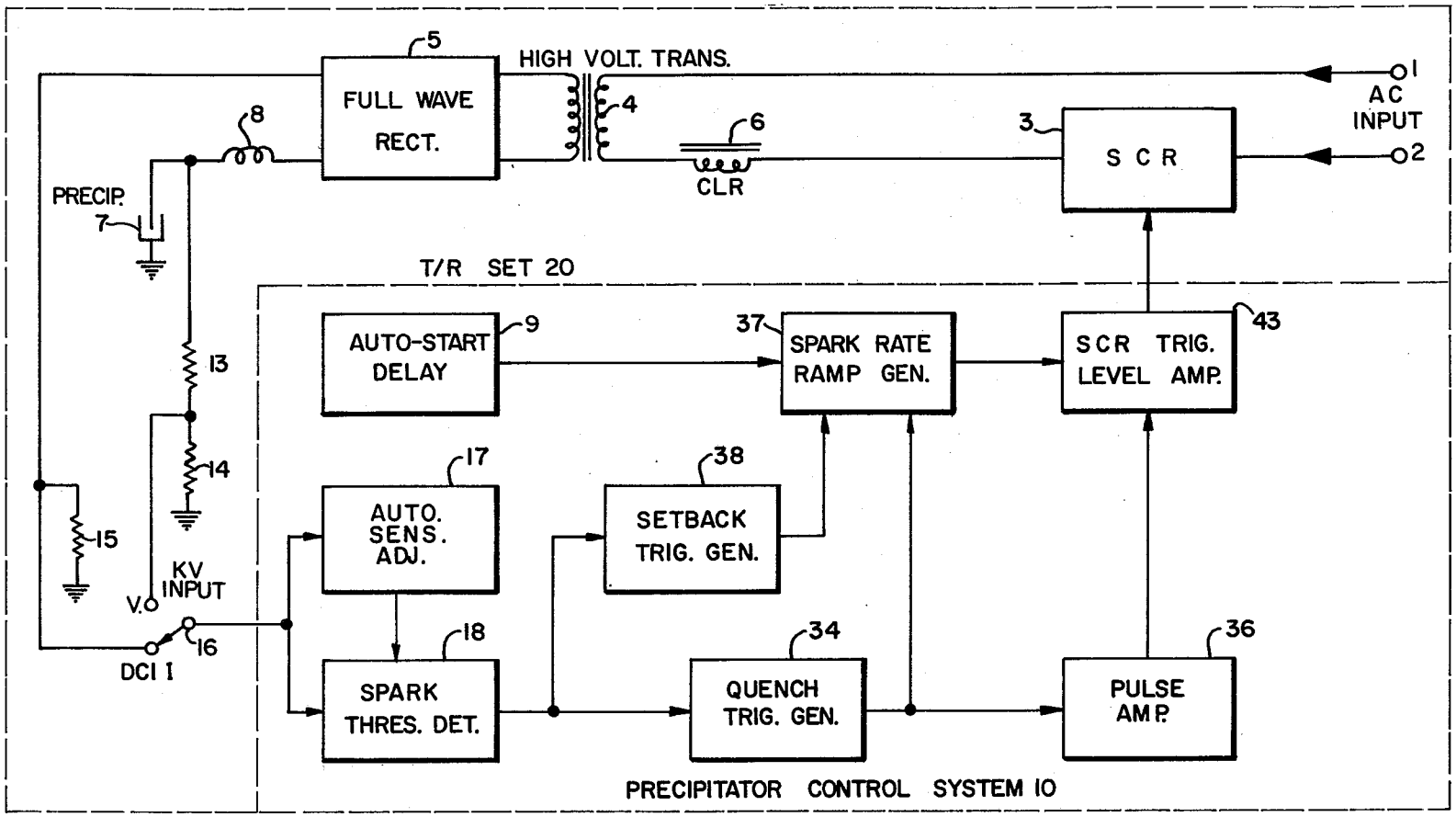
FIG. 1 is a block diagram of a preferred embodiment of the precipitator control system invention.

Referring to the block diagram of FIG. 1, which includes a preferred embodiment of the precipitator control system 10 connected to a precipitator transformer/rectifier (T/R) set 20, power is supplied to the T/R input terminals 1 and 2 from an alternating current source such as 440 volts, 60 hertz. As well known in the art, conduction angle control of silicon controlled rectifier 3 varies the primary winding potential of high voltage transformer 4, thus varying the high voltage AC appearing at the input of full wave rectifier 5. Current limiting reactor 6 protects both the silicon controlled rectifier 3 and precipitator 7 from excessive current. Air core inductor 8 further protects the rectifier by limiting high frequency capacitance discharge current surges generated during precipitator sparking.

AUTO-START DELAY 9

Figure 2:
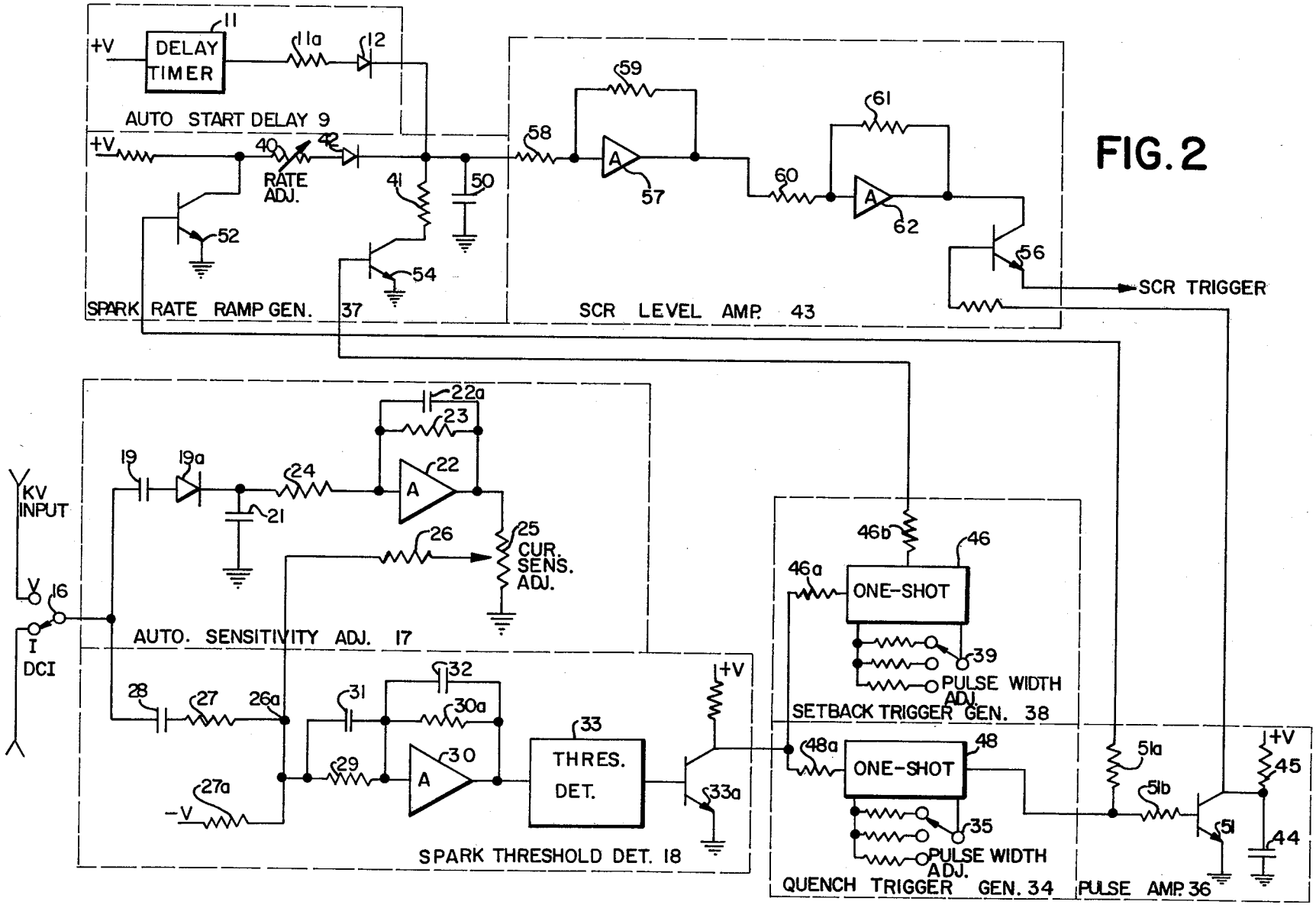
FIG. 2 is a simplified schematic of portions of the precipitator control system of FIG. 1 including the auto start delay, spark rate ramp generator, silicon controlled rectifier (SCR) level amplifier, automatic sensitivity adjustor, spark threshold detector, setback trigger generator, quench trigger generator, and pulse amplifier; and FIGS. *3a–3e* are idealized voltage waveforms illustrating the operation of the precipitator control system in the presence of spark and ripple.

The auto-start delay circuit 9 (FIGS. 1 and 2) supplies a positive voltage at initial power turn-on to ramp generator capacitor 50 for a period (typically 20 seconds) long enough to defeat an undervoltage protection circuit (not shown) that would have falsely interpreted the slow initial voltage buildup on capacitor 50 as a malfunction. The auto-start comprises a conventional delay timer 11 supplying a 20 second positive going pulse at its output when power is first turned on. During the pulse, delay timer 11 supplied current to ramp generator capacitor 50 via current limiting resistor 11*a* and diode 12. The relatively small time constant of resistors 11*a* and capacitor 50 permits the capacitor to quickly charge above the minimum operating voltage threshold of the undervoltage protection circuit. After 20 seconds the output of timer 11 drops to about 0 volts. Diode 12 is then reverse biased and the auto-start delay circuit 9 has no further effect on precipitator control system 10.

AUTOMATIC SENSITIVITY ADJUSTOR 17

A resistance divider sensing circuit consisting of resistors 13 and 14, (FIG. 1) provides a low voltage or attenuated representation "KV Input" of the negative high voltage (approximately 50 KV) appearing on the precipitator 7 ungrounded electrode. A voltage analog of the precipitator current appears across resistor 15 (FIG. 1) as the "DCI" signal. Switch 16 is used to select either the KV Input or DCI signal. The values of resistors 13, 14 and 15 are selected to provide the same DC voltage magnitude (but opposite polarity) from either the KV Input or DCI sensing circuits.

Figures 3A, 3B, 3C, 3D, 3E:
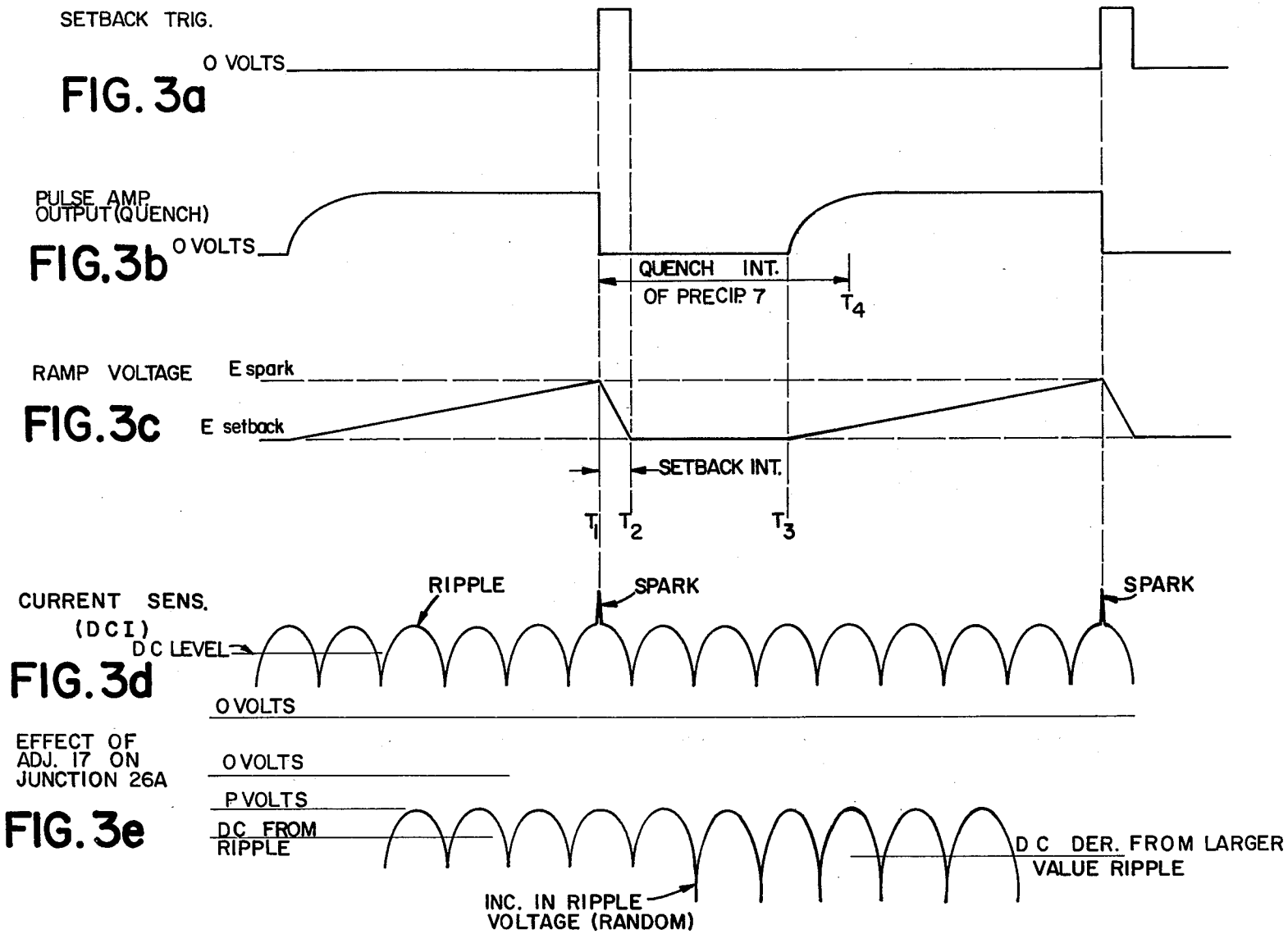

The DCI voltage waveform in the presence of precipitator sparking is shown in FIG. 3*d*. The KV Input signal is similar in that it also contains a DC component, ripple, and when present, a spark pulse. Because of the capacitive action of precipitator 7, the ripple component on the KV Input signal is normally much smaller than that on the DCI signal. Under lossy conditions, i.e. when the conductivity of the particles being removed is high, the precipitator's capacitive action is diminished and the KV Input ripple component increases.

The principal function of the automatic sensitivity adjustor circuit 17 is to derive a compensating signal proportional to ripple magnitude to be used to adjust the DC level of the KV Input or DCI signals in the spark threshold detector logic 18 and so render that circuit's operation sensitive to ripple variations.

The output of switch 16, precipitator sensing signal KV Input or DCI, has its DC component blocked by capacitor 19 and its AC component (ripple) rectified by diode 19*a* and then smoothed to DC by capacitor 21. This rectified ripple signal is further smoothed by operational amplifier 22 which has its bandwidth limited by means of integrating capacitor 22*a*. Resistors 23 and 24 determine the low frequency gain of amplifier 22 as is well known in the art.

Current sensitivity adjustment potentiometer 25 is used to adjust the amplitude of the rectified ripple signal (a DC level) before it is added at the juncture 26*a* of resistors 26 and 27 to the precipitator sensing signal's AC components. (Capacitor 28 blocks the precipitator sensing signal's DC component).

The peak voltage "P" with respect to ground at the junction 26*a* of resistors 26 and 27 (FIG. 3*e*) remains constant as the ripple magnitude varies: the ripple rides about its average value which is added to the negative DC voltage derived from itself. If the ripple were suddenly to get very large, it would cause a more negative DC voltage at the output of operational amplifier 22 which would compensate for the increased ripple voltage at junction 26*a* and the ripple peak voltage with respect to ground at the junction would remain "P".

SPARK THRESHOLD DETECTOR 18

Resistors 29, 30*a* and capacitors 31, 32 are selected to adjust the passband of operational amplifier 30 to reject both low frequency variations pertaining to ripple and very high frequencies associated with extremely narrow width spark pulses. Amplifier 30 optimally passes DC levels and (the low voltage analog) spark pulses that are of sufficient width to be potentially destructive.

As previously stated, the peak voltage "P" at the juncture 26*a* (the input of operational amplifier 30), remains constant with respct to ground as the ripple component varies in amplitude. If an additional AC component (the positive-going spark pulse) were coupled into the resistor 26 and 27 juncture, it would exceed the level P.

Since the voltage described above is at the input of amplifier 30 and the output of amplifier 30 is inverted, the output does not normally exceed in a negative sense −KP volts where K is the gain of amplifier 30. The presence of a spark pulse causes the output of operational amplifier 30 to go negative from voltage −KP for the duration of the pulse.

The output of threshold detector 33 goes rapidly positive when a predetermined threshold is crossed in a negative sense at its inputs. Threshold detector 33 is a conventional operational amplifier configured with regenerative feedback and an input offset circuit. The presence of a spark pulse at the output of operational amplifier 30 causes the output of threshold detector 33 to go positive.

Tied to the output of threshold detector 33, is transistor 33*a*, normally nonconducting. When threshold detector 33 senses a threshold crossing and changes state, transistor 33*a* is driven into conduction triggering one shot multivibrators 46, 48.

QUENCH TRIGGER GENERATOR 34

The quench trigger generator 34 comprises an integrated circuit multivibrator 48 and associated pulse width circuitry. Pulse widths of one, two and three cycles of 60 hertz can manually be selected with switch 35. Output of multivibrator 48 is a positive going pulse fed to both transistor 51 in pulse amplifier 36 and transistor 52 in spark rate ramp generator 37.

SETBACK TRIGGER GENERATOR 38

The setback trigger generator 38 comprises an integrated circuit multivibrator 46 and associated pulse width circuitry. Three different pulse widths are selectable with switch 39. Setback trigger pulse widths are approximately 10% of the quench trigger pulse widths. The output of multivibrator 46 (FIG. 3*a*) is a positive going pulse applied to transistor 54 in spark rate ramp generator 37.

SPARK RATE RAMP GENERATOR 37

The function of the spark rate ramp generator 37 is to generate a slowly increasing voltage ramp whose slope may be manually varied by setting rate adjustment potentiometer 40. Ramp generator capacitor 50 charges (FIG. 3*c*) from voltage supplied by potentiometer 40. The presence of a spark pulse at the input of spark threshold detector 18 causes threshold detector 33 to trigger setback trigger generator 38 and quench trigger generator 34 at time $T_1$. The setback trigger pulse turns on transistor 54 which discharges capacitor 50 through resistor 41 for the duration of the pulse (until time $T_2$). The voltage on ramp generator capacitor 50 drops from $E_{spark}$ to $E_{setback}$ (FIG. 3*c*).

The quench trigger generator 34 output pulse turns on transistor 52 which clamps the potentiometer 40 input to ground. Diode 42 reverses biases and prevents potentiometer 40 from discharging capacitor 50. At the conclusion of the setback pulse, resistor 41 is prevented from discharging capacitor 50 when transistor 54 turns off. Thus, the voltage on capacitor 50 remains essentially at the voltage $E_{setback}$ until the end of the quench pulse at time $T_3$. Transistor 52 turns off at the end of the quench pulse thus allowing potentiometer 40 to once again charge up capacitor 50. Capacitor 50 continues to charge until another spark pulse reinitiates the pulse generation cycle. Accordingly, a sequence of substantially sawtoothed waveforms are produced and it will be understood that the repitition rate of the sequence maybe varied by the setting of potentiometer 40.

The silicon controlled rectifier (SCR) trigger level amplifier 43 performs as a high input impedance amplifier sensing the voltage on capacitor 50 without drawing off charge and as a non-inverting drive source for SCR trigger transistor 56. The output of ramp generator capacitor 50 is applied by way of amplifier 57 and amplifier 62 to the collector of transistor 56. The rates of resistors 59 and 58 and resistors 61 and 60 are selected to provide appropriate spark voltage ramp (FIG. 3*c*) amplification in amplifier 57 and amplifier 62, respectively. Transistor 56, whose output determines the conduction angle of silicon controlled rectifier 3 (FIG. 1), is gated by an output of pulse amplifier 36. The output of transistor 56 follows the spark voltage ramp generated on capacitor 50 except when gated off by pulse amplifier 36. In this manner the output of transistor 56 follows the sequence of substantially sawtoothed waveforms which through SCR 3 controls the repitition rate of the spark.

PULSE AMPLIFIER 36

Pulse amplifier 36 comprises transistor 51 and a trailing edge delay circuit made up of capacitor 44 and resistor 45. The output pulse is derived from the quench trigger pulse and is shown in FIG. 3*b*. The relatively slow rise time of the leading edge of the pulse is necessary to prevent undesirable ringing in the inductive elements of the precipitator's transformer/rectifier set 20. The slow rise time of the leading edge of the pulse amplifier outputs pulse stretches the quench interval beyond $T_3$ to time $T_4$.

In precipitator control system 10, the following components provide the operation and function herein described:

TABLE OF COMPONENTS

| Ref. Numeral | Component | Type |
|---|---|---|
| 11 | Delay timer | NE555 |
| 22 | Operational Amplifier | 741 |
| 30, 33, 57, 62 | Operational Amplifier | UC3403 |

What is claimed is:

1. A control system for automatically controlling a substantially maximum voltage across a precipitator while maintaining a desired spark rate across the electrodes of the precipitator comprising means for producing an attenuated precipitator signal proportional to the signal directly applied to the precipitator including ripple and spark components, spark threshold means for detecting when the attenuated precipitator signal exceeds a predetermined threshold thereby to produce a threshold crossing signal, control means responsive to said threshold crossing signal for providing a ramp signal for varying the voltage applied to the precipitator as a function of the desired spark rate, sensitivity adjust means for producing a compensating signal proportional to the magnitude of the ripple component in the attenuated precipitator signal, and said spark threshold means including means for adjusting the DC level of the attenuated precipitator signal in accordance with the compensating signal so that the spark threshold means is insensitive to variations in the ripple component.

2. The control signal of claim 1 in which said signal producing means includes means for producing said attenuated precipitator signal proportional to the current flowing through or the voltage applied to the precipitator including DC, ripple and spark components.

3. The control system of claim 2 in which said spark threshold means includes means for combining the compensating signal with the attenuated precipitator signal to produce a composite signal which will only exceed the predetermined threshold when a spark component is present.

4. The control system of claim 3 in which said sensitivity adjusting means includes means for producing said compensating signal as a DC level proportional to the magnitude of the ripple in the attenuated precipitation signal.

5. The control system of claims 2, 3 or 4 in which there is provided means responsive to the threshold crossing signal for terminating said ramp signal and after a predetermined time interval for reinitiating the ramp from an initial lower voltage thereby producing a sequence of substantially sawtoothed shaped waveforms having a repitition rate equal to the desired spark rate.

6. The control system of claim 5 in which there is provided silicon control rectifiers for controlling the voltage applied to the precipitator, means for varying the conduction angle of the silicon control rectifiers in accordance with said sawtoothed waveforms.

7. The control system of claim 5 in which said control means includes setback means responsive to occurrence of the threshold crossing signal for terminating and decreasing the ramp signal to a value which is effective to avoid sparking across the precipitator.

8. The control system of claim 6 in which there is provided quench means for disabling the silicon controlled rectifiers for a predetermined time duration upon occurrence of the threshold crossing signal.

* * * * *